United States Patent [19]

Chen et al.

[11] Patent Number: 4,808,296

[45] Date of Patent: Feb. 28, 1989

[54] PROCESS FOR DEWAXING HYDROCARBON FEEDSTOCK

[75] Inventors: Nai Y. Chen, Titusville, N.J.; Dennis E. Walsh, Richboro, Pa.

[73] Assignee: Mobil Oil Corporation, New York, N.Y.

[21] Appl. No.: 18,112

[22] Filed: Feb. 24, 1987

Related U.S. Application Data

[63] Continuation of Ser. No. 789,217, Oct. 18, 1985, abandoned.

[51] Int. Cl.[4] ..... C10G 47/20; C10G 45/54

[52] U.S. Cl. ..... 208/111; 208/120

[58] Field of Search ..... 208/111, 120, 124

[56] References Cited

U.S. PATENT DOCUMENTS

| | | | |
|---|---|---|---|
| Re. 28,398 | 4/1976 | Chen et al. . | |
| 3,980,550 | 9/1976 | Goring et al. . | |
| 4,229,282 | 10/1980 | Peters et al. | 208/111 |
| 4,247,388 | 1/1981 | Banta et al. | 208/111 |
| 4,257,872 | 3/1981 | LaPierre et al. | 208/111 |
| 4,284,529 | 8/1981 | Shihabi | 208/111 |
| 4,434,047 | 2/1984 | Hensley, Jr. et al. | 208/111 |
| 4,439,310 | 3/1984 | Audeh et al. . | |
| 4,448,673 | 5/1984 | Shihabi . | |
| 4,510,045 | 4/1985 | Dessau . | |

*Primary Examiner*—Glenn Caldarola

*Attorney, Agent, or Firm*—Alexander J. McKillop; Charles J. Speciale; Malcom D. Keen

[57] ABSTRACT

The present invention is a catalyst composition and method for dewaxing a wax-containing hydrocarbon feedstock which includes a zeolite characterized by a silica-to-alumina ratio from about 12 to about 200, a Constraint Index of from about 1 to about 12, and an alpha value of not more than about 50, in combination with a Group VIII metal hydrogenation-dehydrogenation component.

12 Claims, 4 Drawing Sheets

420°F + DISTILLATE YIELD VS. POUR POINT
○ - Ni/ZSM5, α 110
□ - PT/ZSM5, α 25
420°F + YIELD, WT. PCT.
100
90
80
70
60
50
0
10
20
30
40
50
60
70
80
420°F + POUR POINT, °F

PEAK HEIGHT RATIO, BRANCHED/NORMAL $C_{16}$
○ - Ni/ZSM5, α= 110
□ - PT/ZSM5, α= 25
NUMBERS NEXT TO DATA POINTS ARE
420°F + DISTILLATE POUR POINTS
(15)
(32)
(68)
(39)
(54)
(73)
BRANCHED/NORMAL $C_{16}$ PEAK HEIGHT RATIO
.5
.4
.3
.2
.1
0
0
10
20
30
40
50
60
650°F + CONVERSION, WT. PCT.

PROCESS FOR DEWAXING HYDROCARBON FEEDSTOCK

This is a continuation of application Ser. No. 789,217 filed on Oct. 18, 1985 now abandoned.

BACKGROUND OF THE INVENTION

The present invention relates to a catalytic hydrocarbon conversion, and, in particular, to catalytic dewaxing processes carried out in the presence of crystalline zeolitic material.

It has been known in art of petroleum processing to reduce the pour point of hydrocarbon oils by reducing those hydrocarbons which readily solidify (waxes) from the hydrocarbon feedstock. Previously, waxy components had been removed by means of low temperature solvent extraction. More recently, however, catalytic techniques have been made available for dewaxing petroleum feedstocks.

A process of that nature developed by British Petroleum is described in The Oil and Gas Journal dated Jan. 6, 1975, at pages 69–73. See also U.S. Pat. No. 3,668,113.

In U.S. Pat. No. Re. 28,398 to Chen et al. a process for catalytic dewaxing is described using with a catalyst comprising zeolite ZSM-5.

U.S. Pat. No. 3,956,102 is connected with a process involving the hydrodewaxing of petroleum distillates utilizing a ZSM-5 zeolite catalyst.

U.S. Pat. No. 4,247,388 to Banta, et al. discloses that the catalytic performance of certain acidic zeolites such as those of the ZSM-5 type in hydrodewaxing operations is improved by controlling the alpha activity of such zeolites to within the range of 55–150, e.g., by treatment with steam.

U.S. Pat. No. 4,284,529 to Shihabi discloses improvements in pour point reduction by means of catalytic dewaxing employing a catalyst prepared from a ZSM-5 type zeolite having a constraint index of about 1 to 12. This dewaxing process employs a low acidity form of zeolite such as ZSM-5 or ZSM-11 in which the low acidity is imparted by steaming the zeolite to reduce its cracking activity to an alpha value of not less than about 5, followed by base ion exchange with an alkali metal cation to reduce the alpha value to no greater than 1.0. A preferred catalyst is referred to therein as a presteamed NaZSM-5 and is employed to dewax crude oils and other waxy feedstocks in the presence or absence of added hydrogen. These catalysts are effective at start-of-run temperature of about 640° F. and exhibit excellent aging behavior in the presence of hydrogen. However, in the absence of hydrogen these catalysts exhibit a gradual aging requiring a daily increase of about 1°–10° F. in the reaction temperature.

U.S. Pat. No. 4,448,673 to Shihabi describes a high silica-to-alumina ratio acidic crystalline zeolite catalyst of a group, which includes ZSM-5, having increased activity. The zeolite catalyst is prepared by steaming a precursor crystalline aluminosilicate in the hydrogen or ammonium form which has an alpha valve of greater than about 20 in the presence of ammonia to provide a crystalline alluminosilicate having an alpha value of from about 10 to about 150 and thereafter ion-exchanging the steamed precursor with an alkali metal cation under conditions effective to further reduce the alpha value to less than about 10.

U.S. Pat. No. 4,510,045 to Dessau discloses a hydrodewaxing process which includes use of an non-acidic medium pore zeolite, such as ZSM-5, activated by steaming in the presence of binders such as alumina.

Catalytic dewaxing as produced today involves shape selective conversion of straight and slightly branched aliphatic compounds of 12 or more carbon atoms. Such conversion includes cracking the paraffinic components, which can reduce the yield of product having acceptable pour point because of loss of low carbon chains resulting from the cracking. Reduction of the waxy component can also result from isomerization of the paraffin chains, which does not effect the overall yield of acceptable product.

This latter dewaxing activity has been known to occur in the case of large pore zeolites. However, large pore zeolites are particularly susceptible to poisoning, such as by nitrogen and thus can require unacceptably high temperature processing to minimize the effect of such poisoning.

As a result of the present invention, however, these and other problems associated with dewaxing of hydrocarbon feedstocks, especially those containing a relatively high content of poisonous compounds such as nitrogen as well as a waxy component have been mitigated.

SUMMARY OF THE INVENTION

The present invention is a process and a catalyst composition, as well as a method of preparing same, for dewaxing a wax containing feedstock by contacting the feedstock under temperature and pressure conditions appropriate for dewaxing with the catalyst composition which includes a zeolite characterized by preferably having an initial silica-to-alumina ratio from about 12 to about 200, a constraint index from about 1 to about 12 and an alpha value of not more than about 50, in combination with a Group VIII metal hydrogenation-dehydrogenation component. The zeolite can be included in a binder as is known in the art, such as a silica or an alumina binder in an amount of, for example, 65% zeolite to 35% binder.

Furthermore, the zeolite has a crystal size of less than about 0.5 micron, and preferably has a crystal size of less than about 0.1 micron.

The Group VIII metal hydrogenation-dehydrogenation component can be incorporated into the medium pore zeolite by impregnation or cation exchange. Ammonium or amine complexes of the matals can be used for exchanging in acidic solutions. The metals can be employed in amounts from about 0.01 to about 5.0 weight percent, and is preferably included in an amount from about 0.1 to about 2.0 weight percent of the zeolite catalyst composite. The exchange can be directly with the metal complex without an intermediate exchange step, or can be performed via known procedures such as ammonium exchange, etc. In one embodiment the platinum can be exchanged via platinum tetraamine nitrate until the platinum content of the final catalyst is about 0.7% by weight.

The catalyst composition of the present invention can be prepared in a method known to those in the art. However, while it is known that acidity can be regulated by synthesizing high silica-to-alumina ratio zeolites, e.g., greater than 200, or by base exchange, it is believed that optimum performance of the catalyst is achieved by reducing the alpha value through severe steaming of the medium pore zeolite. While the present invention is not to be so limited, it is believed that severe steaming achieves the necessary chemical balance between the acid function and the metal function, while imparting enhanced resistance to nitrogen poisoning. This may be due to unique surface topography achieved in the zeolite as a result of the present invention. Thus, the low alpha value can be achieved by steaming the zeolite, having a typical silica-to-alumina ratio of about 70, from about 12 to 20 hours at a temperature of from about 900° to about 1000° F. Any combination of temperature and time can be utilized, so long as the appropriate zeolite alpha value is achieved, which, in one case, has been found to be about 25. The alpha value is preferably from about 5 to about 30, and most preferably from about 15 to about 25.

As a result of the present invention, it is now been found that medium pore zeolites wich exhibit resistance to poisoning by components such as nitrogen, etc., can be used to provide a high yield of low pour point product by, among other things, isomerization as well as cracking.

This invention is particularly suited to dewaxing crude oils or other waxy stocks, and the process may be conducted in the presence or absence of added hydrogen.

For a better understanding of the present invention, together with other and further objects, references made to the following description, taken in conjunction with the accompanying drawings, and its scope will be pointed out in the appended claims.

BRIEF DESCRIPTION OF THE DRAWINGS

Specific examples of the present invention have been chosen for purposes of illustration and description and the efficacy is described in the accompanying drawings wherein.

DETAILED DESCRIPTION OF THE INVENTION

Figure 1:
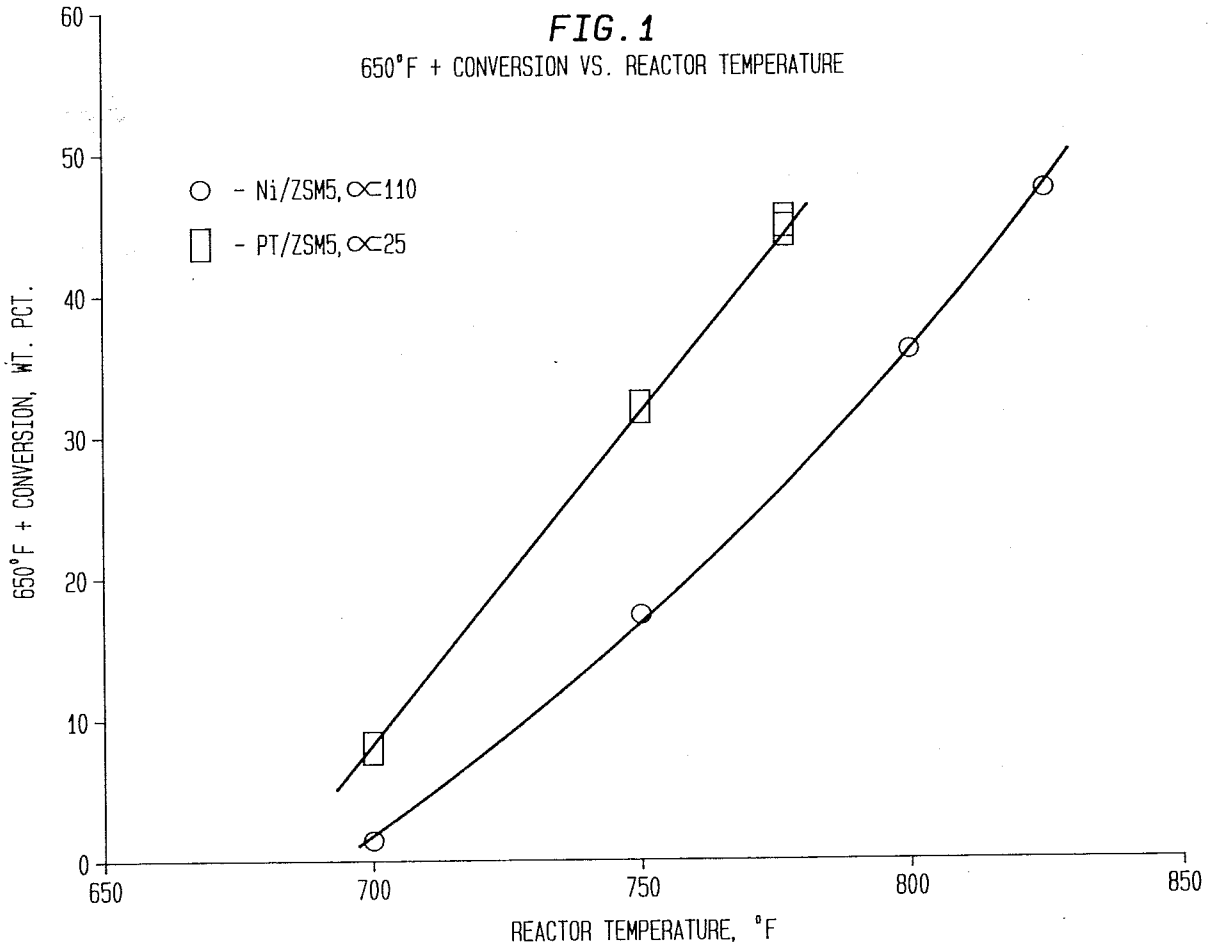
FIG. 1 is a graph which discloses a comparison of the activity exhibited by the process of the present invention.

The the present invention involves in one aspect the use of zeolite catalysts which are characterized by preferably having an initial silica-to-alumina ratio of at least 12:1 to about 200 and a Constraint Index from 1 to about 12, especially the zeolites of the ZSM-5 family. The Constraint Index of the zeolite provides a measure of the extent to which the zeolite controls the access by molecules of various sizes to its internal structure. Generally, the small pore zeolites which provide highly restricted access, have constraint indices of above 12 while the large pore zeolites usually have constraint indices below 1. The zeolites of the ZSM-5 family have constraint indices which are usually in the range from about 1 to about 12. A method for determining Constraint Index is described in U.S. Pat. No. 4,016,218 and Journal of Catalysis 67,218–222 (1981), together with values of constraint index for typical zeolites, to which reference is made for details of the method. Constraint Index is a structural characteristic of the zeolite but is measured by a test based upon its cracking activity. Cracking activity may, of course, be varied by artifices such as steaming, variation of structural silica:alumina ratio and alkali metal exchange.

The ZSM-5 family includes ZSM-5 itself as well as ZSM-11, ZSM-12, ZSM-22, ZSM-35, and ZSM-38.

The ZSM-5 which can be used in the present invention is described in U.S. Pat. No. 3,706,886; ZSM-11 in U.S. Pat. No. 3,709,979; ZSM-12in U.S. Pat. No. 3,832,449; ZSM-23 in U.S. Pat. No. 4,076,842; ZSM-35 in U.S. Pat. No. 4,016,245; and ZSM38 in U.S. Pat. No. 4,046,859. The present invention, however, is not to be limited by any particular zeolite, but rather is directed to those zeolites which are of the medium pore variety, such that the Constraint Index selectivity admits the appropriate molecular chains which undergo conversion and/or isomerization. The crystal size of the present invention zeolites should be not less than about 0.5 micron, and preferably less than about 0.1 micron.

Furthermore, the acid activity of the zeolite catalyst used in the present invention can be conveniently defined by an alpha scale described in an article published in *Journal of Catalysis,* Vol. 6, Page 278–287 1966, and in U.S. Pat. No. 4,016,218. In this test, the zeolite catalyst is contacted with hexane under conditions described in the publication and the amount of hexane which is cracked is measured. From this measurement is computed an "alpha" value which characterizes the catalyst for its cracking activity for hexane. The above references are incorporated herein. The alpha scale so described is used herein to define activity level for cracking n-hexane.

Specifically with regard to the present invention, the alpha level is preferably reduced to a value below 50, and more preferably between about 5 and 30, by severe steaming of the zeolite catalyst, which is atypically low for zeolite catalysts used in catalyst hydrodewaxing procedures.

The catalyst of the present invention also includes a hydrogenation-dehydrogenation component selected from one of the Group VIII metals which can be deposited or incorporated in the zeolite catalyst by methods of exchange known in the art. Especially effective are those medium pore zeolites which contain platinum or palladium values. The hydrogenationdehydrogenation component from Group VIII can be incorporated by impregnation or cation exchange as explained hereinbefore. Usually they are incorporated in amounts from about 0.1 to about 5 weight percent and preferably from about 0.1 to about 2.0 weight percent of the catalyst composite.

Prior to incorporating the hydrogenation-dehydrogenation component, the zeolite can be mixed with alumina or another binder, such as silica, prior to steaming. Alumina is generally considered the preferred material since, as a binder for the zeolite, the mechanical properties can be improved. Mixing may be carried out by any convenient procedure sush as simple physical mixing, ball-milling, or wet mulling. The raito between the two materials is not critical but will usually be from 10:90 to 90:10 (by weight) and more usually from 20:80 to 80:20. After mixing is complete, the mixture can be formed in convenient shapes for hardening, e.g., by dry pressing or by extrusion. The blends can then be precalcined to stabilize at supported temperatures of about 1000 degree F. and about for about 0.5 to about 10 hours or longer as required.

The feedstocks which can be treated according to the novel process and catalyst of the present invention are any hydrocarbon feeds which require dewaxing processing, but are especially effective with waxy feedstocks containing catalytic-poisons such as nitrogen.

Conditions for the process in accoradnce with the present invention can include temperatures in the range from between about 400° to about 900° F., and is preferably conducted in a range of about 500° to about 800° F. The pressure can be in a range of from about 100 to about 3000 psig and is preferably to about 200 to about 2000 psig, and most preferably 300 to about 600 for hydrodewaxing. The reaction environment can include hydrogen, in which case partial pressure of hydrogen can be from about 50 to about 2500 psi and is preferably between about 150 to about 1800 psi, while the liquid hourly space velocity (LHSV) is from about 0.1 to about 50 and preferably is about 0.5 to about 4. These conditions can be varied as the feedstock requires, e.g., whether it be crude feedstock and/or distillate fractions, etc. Accordingly, much higher total pressures and higher hydrogen partial pressure can be utilized as needed.

SPECIFIC EXAMPLES OF THE PRESENT INVENTION

A PT/ZSM-5 low acidity medium pore zeolite was prepared by steaming a ZSM-5 extrudate having a zeolite content of about 65% with an alumina binder of about 35%, to an alpha value of about 25 based on the zeolite content. The supported catalyst was then ammonium exchanged using ammonium nitrate, filtered and washed, followed by a drying period. Then platinum values were incorporated in the catalysts composite via Pt exchange using platinum tettraamine nitrate, followed by filtration, washing and drying and calcination at 350° for a time period of about three hours. The resulting platinum content of the final catalyst was about 0.7% by weight based on the extrudate.

Experiments were then conducted to compare the performance of this catalyst against that of conventional distillate dewaxing catalysts used in the upgrading of waxy heavy coker gas oil, which consisted of a ZSM-5 catalyst having an alpha value of about 110 and a nickel component of about 1% based on the weight of the catalyst. The properties of the feedstock are shown in Table 1.

TABLE 1

| PROPERTIES OF HEAVY COKER GAS OIL | |
|---|---|
| C, Wt. % | 86.00 |
| H, Wt. % | 13.44 |
| O, Wt. % | 0.20 |
| N, Wt. % | 0.116 |
| S, Wt. % | 0.17 |
| Basic N, ppm | 500 |
| Ni, ppm | 2.1 |
| V, ppm | 0.6 |
| Br No. | 21 |
| Conradson Carbon No. (Wt. %) | <0.1 |
| Pour Point, °F.* | 85 |
| Paraffins, Wt. % | 38.6 |
| Mononaphthenes, Wt. % | 21.8 |
| Polynaphthenes, Wt. % | 14.6 |
| Aromatics, Wt. % | 25.1 |
| 420° F.−, Wt % | 0.2 |
| 420–650° F., Wt. % | 46.3 |
| 650–850° F., Wt. % | 44.5 |
| 850° F.+, Wt. % | 9.0 |

These experiments were conducted in a fixed bed high pressure reactor operating generally at a 1.0 liquid hourly space velocity (LHSV) and at about 400 psig. Conversion and product pour point were varied by changing the reactor temperature. The results of the experiments have been reported as data points in FIGS. 1 through 4.

FIG. 1 illustrates the higher conversion activity exhibited by the Pt/ZSM-5 catalyst. Depending on the conversion level, the required temperature is 25° to 40° F. lower than that observed with the high acid medium pore size zeolite catalyst, which, in the case of gross production, can mean substantial savings.

Figure 2:
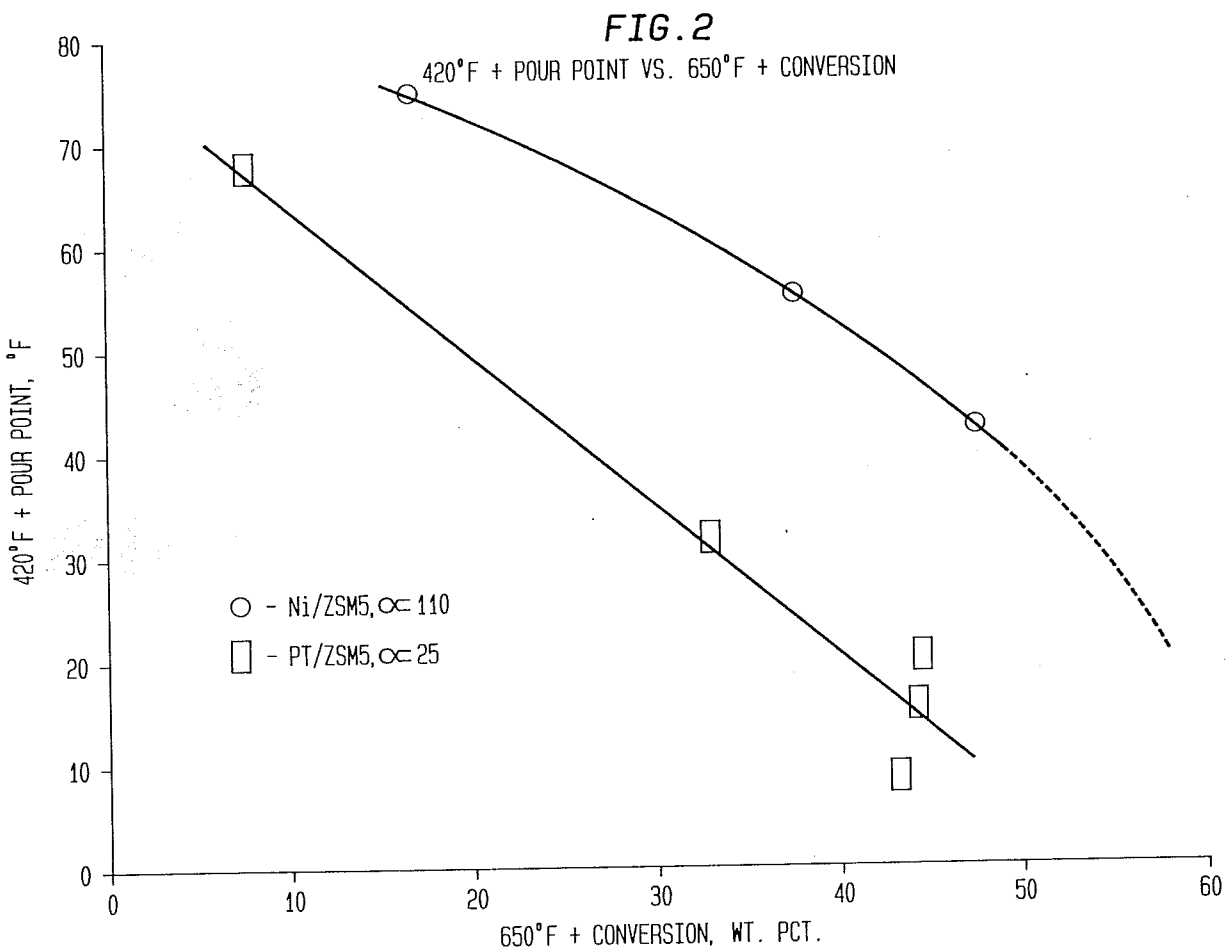
FIG. 2 shows a comparison of the amount of conversion required to obtain a distillate target pour point.

In FIG. 2 it has been shown that at any conversion level the 420° F.+ distillate pour point obtained using the Pt/ZSM-5 zeolite catalyst is significantly lower than that achieved with conventional distillate dewaxing catalyst. In other words the conversion required to obtain a given distillate target pour point, which its preferably 15° to 20° F., is lower with the low acidity platinum containing catalyst. Thus, the estimated conversion difference at 20° F. pour point is 15 to 20%.

Figure 3:
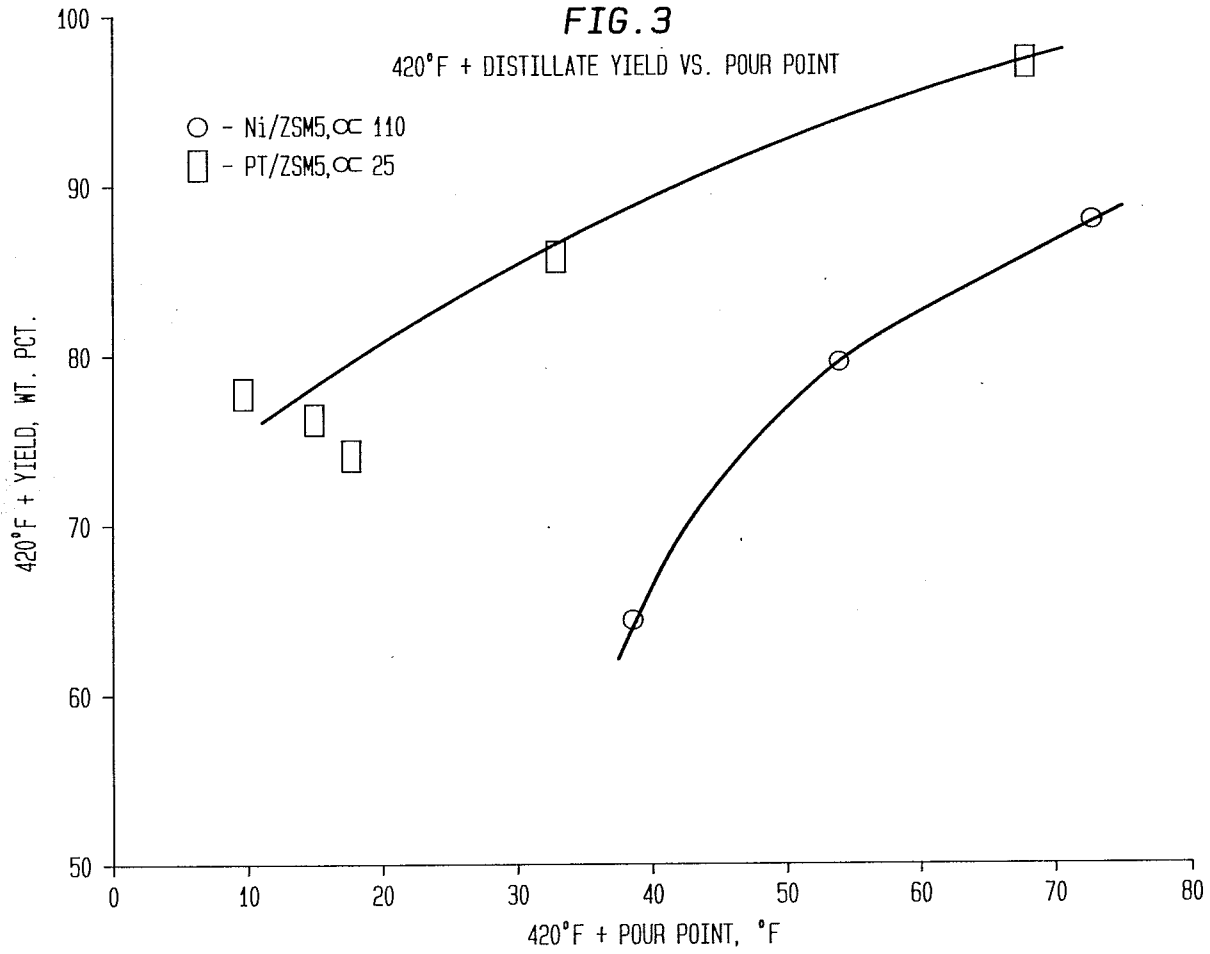
FIG. 3 is a graph which shows the higher distillate yields resulting from the lower converion resulting from the present invention.

Furthermore, lower required conversion is reflected in higher distillate yields as clearly shown in FIG. 3. According to the results shown, 20 to 25% more distillate is obtained from the Pt/ZSM-5 catalyst at 40° F. pour point, and this difference increases as the target pour point further decreases. The higher yield from the low acidity catalyst results from increased isomerization reduced cracking to lower molecular weight products as compared to the high acidity nickel containing catalyst.

Figure 4:
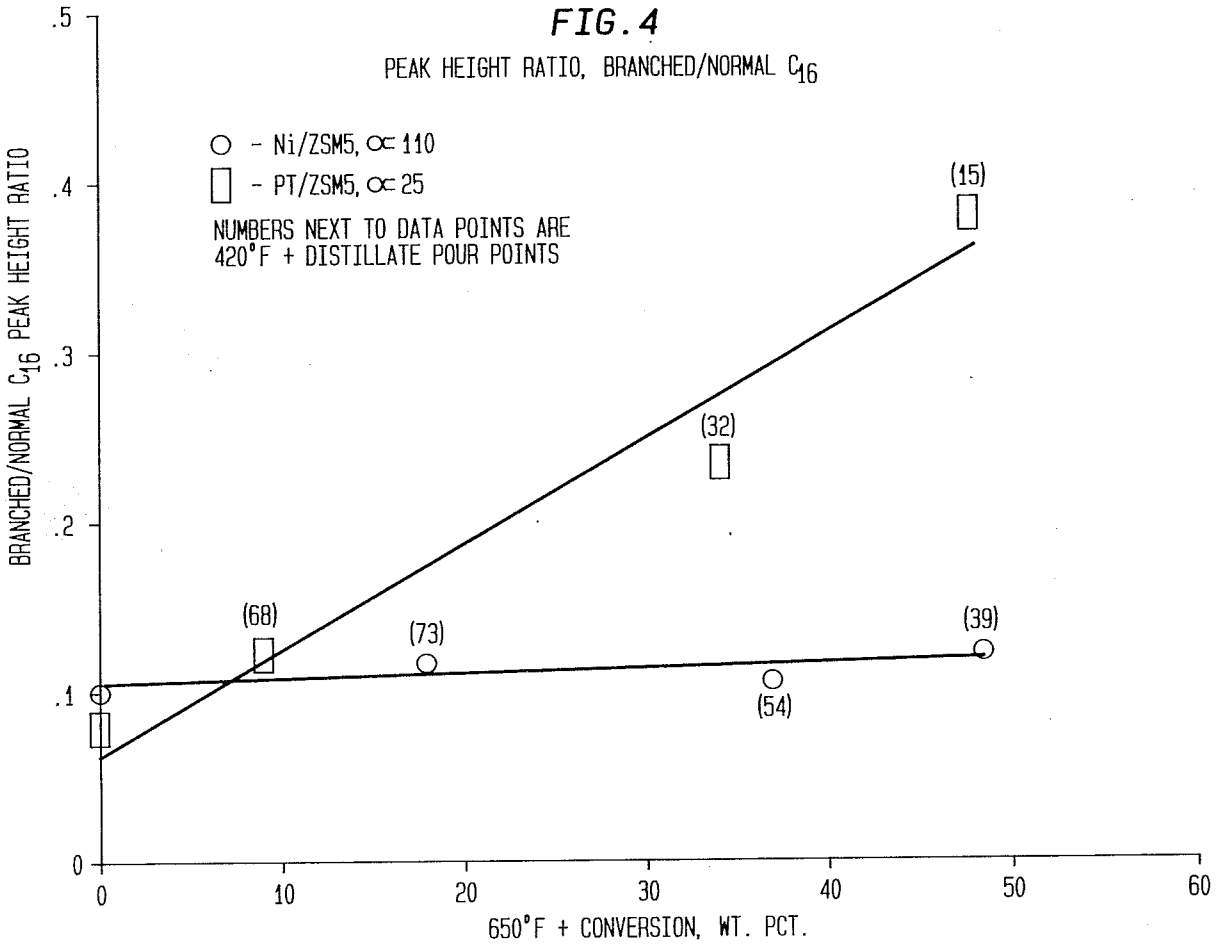
FIG. 4 is a graph indicating the increased isomerization and reduced cracking resulting from the present invention.

Indicative of this latter point are the results shown in FIG. 4, wherein the peak height ratio obtained from gas chromatography traces of branched to normal $C_{16}$ products is plotted against conversion. With increasing conversion, the ratio increases for the Pt/ZSM-5 while that observed with the high acid zeolite catalyst is nearly flat. Again, at the same conversion level, much lower pour points are observed for the Pt/ZSM-5 which exhibits the increasing ratio, Thus, while there have been described what are presently believed to be the preferred embodiments of the invention, those skilled in the art will realize that changes and modifications may be made their too without departing from the spirit of the invention, and it is intended to claim all such changes and modifications as fall within the true scope of the invention.

What is claimed is:

1. A process for hydroisomerizing a wax-containing hydrocarbon feedstock comprising:

contacting said wax-containing hydrocarbon feedstock with a catalyst including a zeolite characterized by a Constraint Index of from about 1 to about 12, and an alpha value of from about 5 to about 50 based on zeolite, in combination with a Platinum metal hydrogenation-dehydrogenation component at a temperature of from about 400° to about 900° F. and at a pressure of from about 200 to 2000 psig.

2. The process of claim 1 wherein said metal is incorporated in said zeolite in an amount of from about 0.01 to about 5% by weight of said zeolite catalyst.

3. The process of claim 2 wherein said metal is incorporated in an amount of from about 0.1 to about 2.0% by weight.

4. The process of claim 1 wherein said zeolite catalyst is supported in a binder selected from one of silica and alumina.

5. The process of claim 4 wherein the composite resulting from said supported zeolite is about 65% zeolite and about 35% alumina.

6. The process of claim 1 wherein said zeolite is ZSM-5.

7. The process of claim 1 wherein said alpha value is attained by steaming said zeolite.

8. The process of claim 7 wherein said alpha value is not more than about 30 based on zeolite.

9. The process of claim 8 wherein said alpha value is from about 15 to about 25 based on zeolite.

10. The process of claim 1 wherein said feedstock contains nitrogen components.

11. The process of claim 1 wherein said temperature is from about 500° to about 800° F.

12. The process of claim 1 wherein said pressure is from about 340 to about 600 psig.

* * * * *